US010101086B2

(12) United States Patent
Bertram

(10) Patent No.: US 10,101,086 B2
(45) Date of Patent: Oct. 16, 2018

(54) SYSTEMS, APPARATUS, AND METHODS FOR TREATING WASTE MATERIALS

(71) Applicant: Integrated Energy LLC, Huntington Beach, CA (US)

(72) Inventor: Karen Meyer Bertram, Huntington Beach, CA (US)

( * ) Notice: Subject to any disclaimer, the term of this patent is extended or adjusted under 35 U.S.C. 154(b) by 325 days.

(21) Appl. No.: 14/740,195

(22) Filed: Jun. 15, 2015

(65) Prior Publication Data

US 2015/0362183 A1 Dec. 17, 2015

Related U.S. Application Data

(60) Provisional application No. 62/011,903, filed on Jun. 13, 2014.

(51) Int. Cl.

| | |
|---|---|
| ***F27B 7/30*** | (2006.01) |
| ***F23G 5/20*** | (2006.01) |
| ***F23G 5/44*** | (2006.01) |
| ***F23G 5/027*** | (2006.01) |

(52) U.S. Cl.

CPC ..... *F27B 7/30* (2013.01); *F23G 5/0276* (2013.01); *F23G 5/20* (2013.01); *F23G 5/44* (2013.01); *F23G 2203/20* (2013.01); *F23G 2203/8013* (2013.01); *F23G 2900/508* (2013.01)

(58) Field of Classification Search

CPC ..... F23G 2203/8013; F23G 5/027; F23G 5/0276; F23G 5/0273; F23G 5/44; F23G 5/20; F23G 2203/20; F23G 2900/52001; F23G 2900/52002; F23G 2900/52003; C02F 11/10; F28F 2215/10; F28D 7/10; F27B 7/20; F27B 7/22; F27B 7/30

USPC ..... 110/229; 165/182

See application file for complete search history.

(56) References Cited

U.S. PATENT DOCUMENTS

| | | | | |
|---|---|---|---|---|
| 1,399,503 | A * | 12/1921 | McCrae | F27B 7/20 138/114 |
| 3,972,682 | A | 8/1976 | Stephens et al. | |
| 4,026,264 | A | 5/1977 | Henriques | |
| 4,226,584 | A * | 10/1980 | Ishikawa | F23G 5/20 110/246 |
| 4,739,154 | A | 4/1988 | Bharara et al. | |
| 4,878,440 | A * | 11/1989 | Tratz | C10B 47/30 110/229 |
| 5,411,714 | A | 5/1995 | Wu et al. | |
| 5,636,580 | A | 6/1997 | Kanis | |
| 5,653,183 | A | 8/1997 | Hansen et al. | |
| 6,619,214 | B2 | 9/2003 | Walker | |
| 7,000,551 | B2 | 2/2006 | Cole et al. | |
| 7,044,069 | B2 | 5/2006 | Cole et al. | |

(Continued)

FOREIGN PATENT DOCUMENTS

| | | |
|---|---|---|
| GB | 766003 | 1/1957 |

*Primary Examiner* — David J Laux
(74) *Attorney, Agent, or Firm* — Fish IP Law, LLP

(57) ABSTRACT

A pyrolytic converter for treating waste materials has an elongated oven that has different channels. The different channels share the length of the elongated oven and divided to occupy different portions of a cross section of the oven. The pyrolytic converter also has a heating source that is configured to supply heat to a portion of the waste materials located within a channel at a specific temperature and to supply heat to another portion of the waste materials located within a different channel at a different temperature.

11 Claims, 5 Drawing Sheets

(56) References Cited

U.S. PATENT DOCUMENTS

| | | | | |
|---|---|---|---|---|
| 7,063,528 | B2 | 6/2006 | Klobucar et al. | |
| 7,216,464 | B2 | 5/2007 | Neal et al. | |
| 7,354,266 | B2 * | 4/2008 | Miller | F27B 7/161 241/183 |
| 7,614,388 | B2 | 11/2009 | Wicks | |
| 7,832,343 | B2 | 11/2010 | Walker et al. | |
| 8,328,993 | B2 | 12/2012 | Feerer et al. | |
| 8,419,902 | B2 | 4/2013 | Feerer et al. | |
| 8,835,704 | B2 | 9/2014 | Hornung et al. | |
| 2011/0271882 | A1 | 11/2011 | Cole et al. | |
| 2012/0227680 | A1 | 9/2012 | Kerr et al. | |
| 2014/0182828 | A1 * | 7/2014 | Lekhin | F28F 9/013 165/179 |
| 2015/0368563 | A1 * | 12/2015 | Funk | F23G 5/0276 201/33 |

* cited by examiner

SYSTEMS, APPARATUS, AND METHODS FOR TREATING WASTE MATERIALS

This application claims the benefit of priority to U.S. Provisional Application 62/011,903, filed Jun. 13, 2014, the contents of which are incorporated by reference in their entireties. Where a definition or use of a term in a reference that is incorporated by reference is inconsistent or contrary to the definition of that term provided herein, the definition of that term provided herein is deemed to be controlling.

FIELD OF THE INVENTION

The present invention is generally related to waste materials treatment.

BACKGROUND

The background description includes information that can be useful in understanding the present invention. It is not an admission that any of the information provided herein is prior art or relevant to the presently claimed invention, or that any publication specifically or implicitly referenced is prior art.

Waste management and the creation of renewable energy are common problems in many nations. Pyrolysis, which can be used to turn waste into renewable energy, is one solution to both problems. Pyrolysis involves using high temperatures in a relatively oxygen free environment to decompose waste materials (also known as feedstock) to generate a synthetic gas, or "syngas." The syngas can then be burned to produce renewable energy. Common feedstocks include trash, old tires, and other municipal, industrial, agricultural, or domestic wastes.

Pyrolysis is normally performed using a pyrolytic oven. The pyrolytic oven provides the heat and the necessary environment for pyrolysis to occur. A pyrolytic oven's efficiency is achieved by maximizing the heat transfer from the oven to the feedstock to ensure that the feedstock is completely heated and processed. This can be a challenge because feedstocks can vary greatly in composition and base temperature. In an attempt to increase efficiency, some previous pyrolitic oven designs have sought to improve the way that the feedstock is heated and cycled through the oven. For example, U.S. Pat. No. 6,619,214 to Walker teaches a pyrolytic converter with a screw and paddle conveyor system, which allows the feedstock to be mixed, lifted, and pushed through the pyrolytic oven. U.S. Pat. No. 7,832,343 to Walker and Bertram teaches a pyrolyzer with dual processing shafts and heat transfer fins to transfer heat to the heating chamber. However, both of these approaches are still inefficient at processing waste.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improving the efficiency of pyrolytic ovens while decreasing overall construction, operational, and maintenance costs.

SUMMARY OF THE INVENTION

The present inventive subject matter provides a pyrolytic converter for treating waste materials. The pyrolytic converter has an elongated oven that has different channels. The different channels share the length of the elongated oven and divided to occupy different portions of a cross section of the oven. The pyrolytic converter also has a heating source that is configured to supply heat to a portion of the waste materials located within a channel at a specific temperature and to supply heat to another portion of the waste materials located within a different channel at a different temperature.

DETAILED DESCRIPTION

Figure 1A:
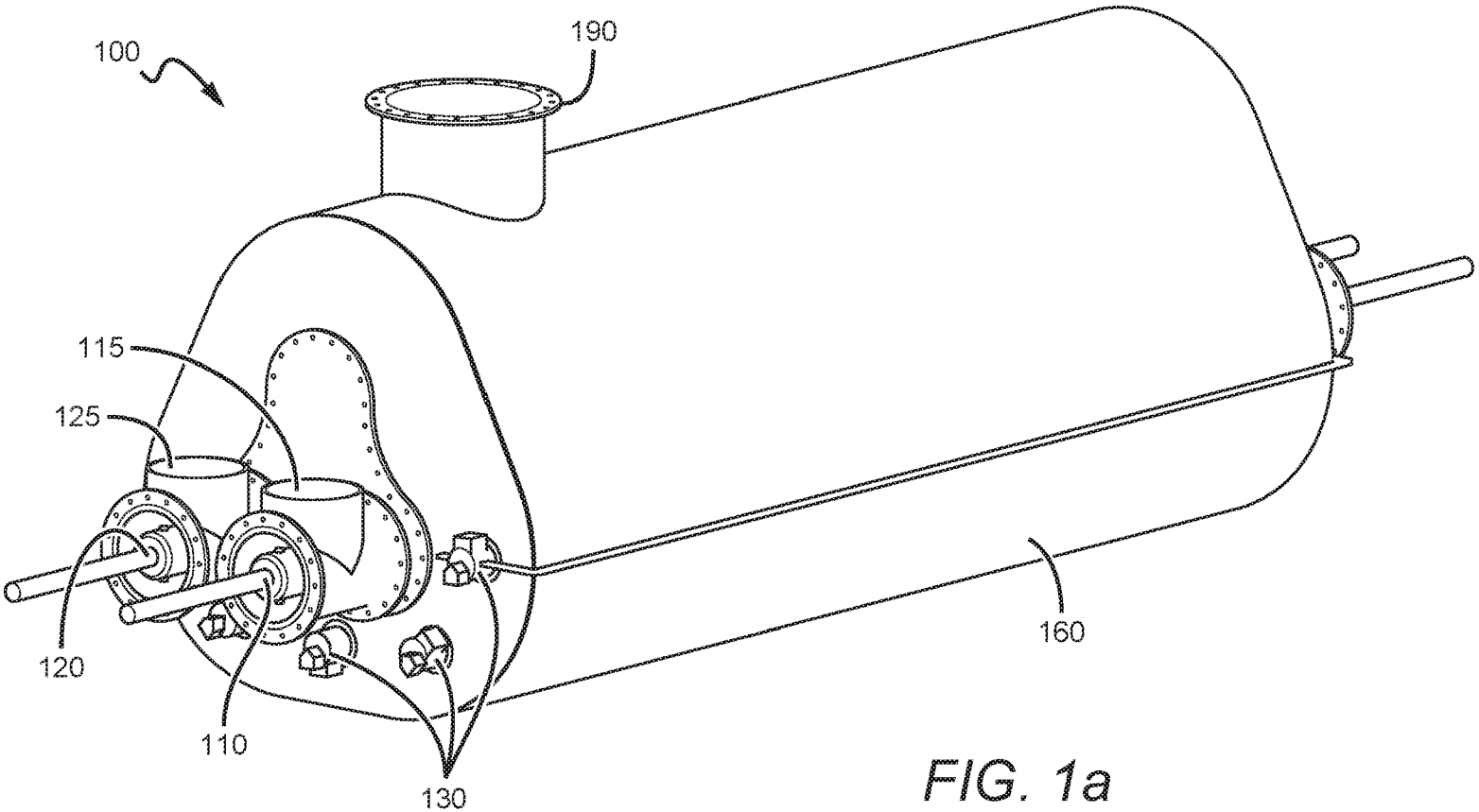
FIGS. 1*a* and 1*b* are right and left perspective views, respectively, of a pyrolytic oven assembly.

The following discussion provides many example embodiments. Although each embodiment represents a single combination of components, this disclosure contemplates combinations of the disclosed components. Thus, for example, if one embodiment comprises components A, B, and C, and a second embodiment comprises components B and D, then the other remaining combinations of A, B, C, or D are included in this disclosure, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, numerical parameters expressing quantities are used. It is to be understood that such numerical parameters may not be exact, and are instead to be understood as being modified in some instances by the term "about." Accordingly, in some embodiments, a numerical parameter is an approximation that can vary depending upon the desired properties sought to be obtained by a particular embodiment.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, ranges set forth herein should be interpreted as being inclusive of their endpoints and open-ended ranges should be interpreted to include only commercially practical values. The recitation of ranges of values herein is merely intended to serve as a shorthand method of referring individually to each separate value falling within the range. Unless otherwise indicated herein, each individual value within a range is incorporated into the specification as if it were individually recited herein. Similarly, all lists of values should be considered as inclusive of intermediate values unless the context indicates the contrary.

Methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the described concepts and does not pose a limitation on the scope of the disclosure. No language in the specification should be construed as indicating any non-claimed essential component.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

One aspect of the inventive subject matter provides for an apparatus for waste material through a continuous-feed pyrolytic thermal converter that can be integrated with subsystems to generate energy. In operation, the pyrolytic thermal converter is process the waste through indirect heating of the retort oven. The unique multipass heating of the radiant and convective areas of the oven combined with the innovative heating/temperature control channels.

The novel approach utilizes the heating/temperature control channels for dual purposes (1) with the system segmented, with multiple heating channels, each running the full length of the oven, each heating channel can be controlled to optimize the heat input into the system to eliminate over-heating areas and under-heating other areas. Allowing for better performance and energy efficiencies, and (2) the multiple heating channels are not only designed for better heat transfer in the oven, but also have been incorporated as an innovative and functional support for the oven within the specially designed insulated outer shell.

Figure 1B:
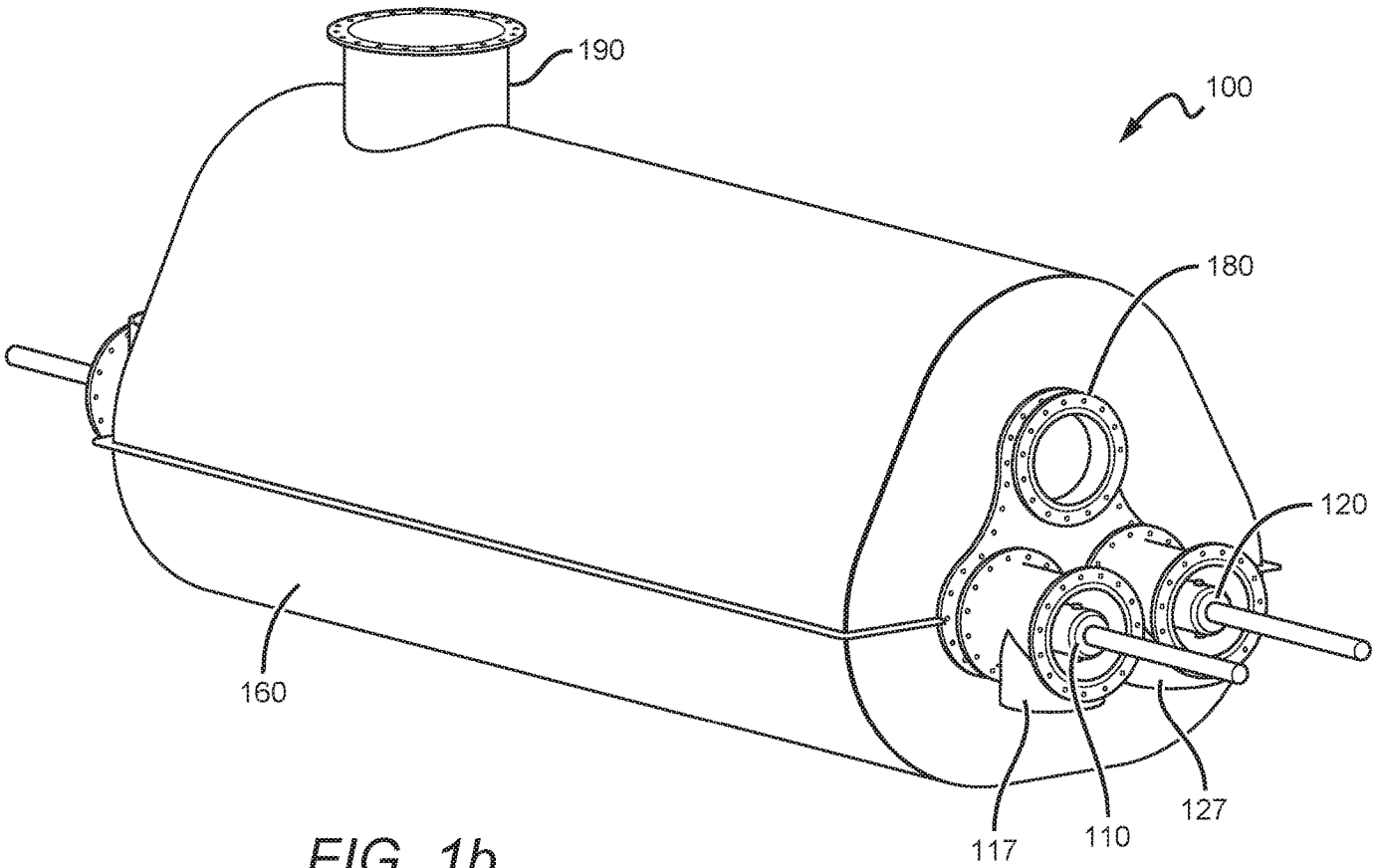

FIG. 1*a* illustrates an example pyrolytic oven 100. In some embodiments, pyrolytic oven 100 is covered by shell 160. In some embodiments, pyrolytic oven 100 has rotary augers 110 and 120. Rotary augers 110 and 120 receive a feedstock through input holes 115 and 125, respectively. In some embodiments, pyrolytic oven 100 also has burners 130. FIG. 1*b* illustrates a back view of pyrolytic oven 100, and shows exit holes 117 and 127 and aperture 180.

The waste material is conveyed into the pyrolytic converter through multiple sets of rotary valve air locks. Each set is comprised of two air locks that stage the waste for transport through the pyrolytic converter. The novel high temperature conveyance augers are comprised of three distinct sections to more efficiently move the waste and the subsequent residual material through the retort oven. There are multiple conveyance augers, as little as two and as many as four, operate in opposite directions to allow for more efficient distillation or decomposition.

The in-feed is designed to use rotary valve air locks for the continuous feed of waste into the thermal converter/oven. An innovative in-feed system has been designed to deliver the waste into dual Rotary airlock systems that discharge the waste into the oven evenly. With two separate airlock systems, the waste or feedstock material is disbursed over the dual transport screw conveyances inside the converter oven. The dual air lock systems allow for higher volume throughput into the system.

Figure 2:
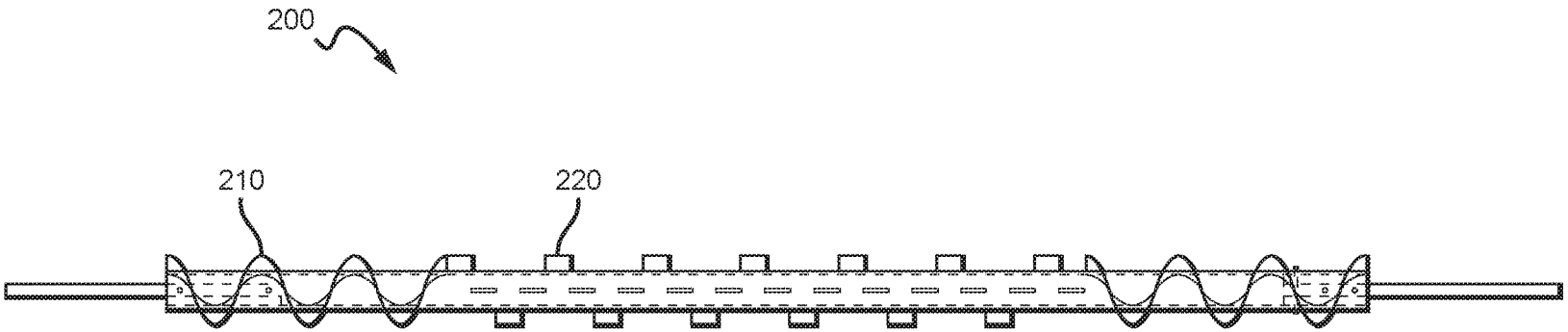
FIG. 2 is a right elevation view of a screw auger for a pyrolytic oven.

FIG. 2 illustrates one embodiment of a screw auger 200. Screw auger has at least one screw 210 and a series of paddles 220 along different segments of the length of screw auger 200. It is contemplated that some embodiments may have more than one screw portion or more than one paddle portion.

The first section of the auger conveyor will be designed as a traditional screw conveyor with helical flights capable of transporting the volumes of mixed waste that is continuously dropped into the oven through the air locks. The second section is comprised of staggered angled paddle flights that are designed to move the partially decomposed waste material. The final section of the auger conveyor is a screw design that is the same as the first section to move the char residual into the discharge conveyor. This unique design allows for the high temperature char residual to flow evenly and not accumulate on the bottom of the oven causing premature wear and corrosion.

The carbon char residual from the process is discharged through the final set of airlocks into an enclosed screw conveyor while the syngas produced in the process leaves the thermal converter to a thermal oxidizer or other subsystem for power generation.

In some embodiments, the first part of the screw is be a traditional screw design and then into a paddle configuration with the third section. Each of these sections has a different function as it transports the waste or feedstock through the oven. The in-feed waste or process material is heavier and requires the screw in the first section to allow for the initial decomposition of the waste, and the paddle flights will push the smaller fraction that remains through the converter oven until the char is the only remaining residual and needs to be discharged into another screw conveying system.

The screw configuration has advantages over paddle flights for the discharge of the char residual. After the decomposition of the waste or feedstock material the char residual must be discharged out of the oven into a conveyor system. The char residual is hot and the screw configuration will allow for the material to be transported more efficiently and will prevent a build-up of material at the end of oven. This build-up of high temperature carbon char may allow for undue wear on this section of the oven. This will ensure that there is no residual material remaining on the floor of the oven for any extended period of time. The screw configuration is optimized for the various functions it performs in the converter oven. The rotation of the transport conveyances allows for better mixing and more surface space to be exposed for easier decomposition.

The multiple screw/conveyor auger design that allows for the flow of waste being processed within the oven. The innovative screw has been designed with three distinct segments. Each segment has a specific purpose allowing the waste as it processed to flow as it decomposes in the thermal oven. The system is designed to have two of these auger conveyors made of high temperature corrosion-resistant alloy or stainless steel. The two screws or transport conveyances will turn in opposite directions to provide better mixing and distribution of the waste or feedstock material through the converter oven.

Benefits of the contemplated inventive subject matter include having a more efficient method for processing liquid waste streams into the process, atomization will allow for more surface space for faster decomposition. In addition, this method for handling the liquid waste streams will be safe approach to handling fluids. Mixing liquid and solid waste is problematic and may cause some maintenance issues on belt conveyors and other mechanical parts. This method prevents these problems since it will keep the waste streams separate. Atomizing the liquid waste will allow for even disbursement and can controlled so that it can optimize the energy output.

Figure 3A:
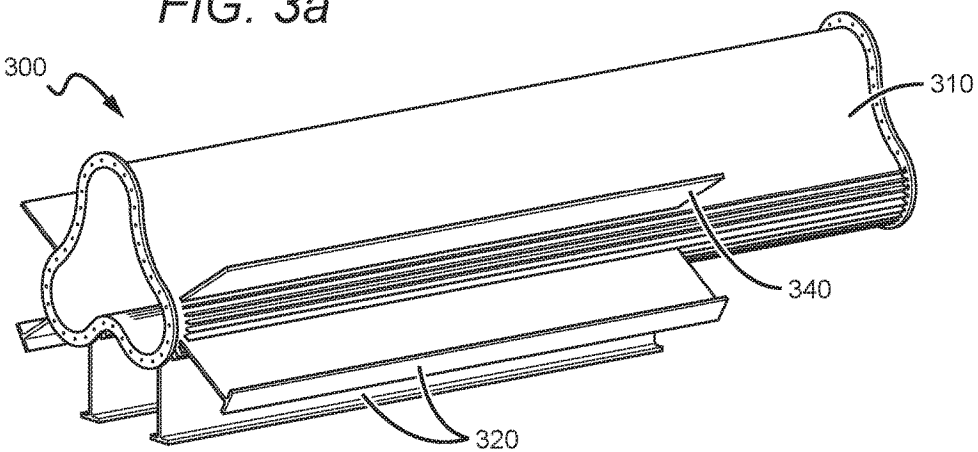
FIGS. 3*a*, 3*b* and 3*c* are perspective views of a heating chamber of a pyrolytic oven with blades and heat sinks.

FIG. 3*a* illustrates a heating chamber 300 of a pyrolytic oven. Heating chamber 300 has upper support blades 340 and lower support blades 320. Upper support blades 340 and lower support blades 320 divide heating chamber 300 along a longitudinal direction to create temperature heat channels. In one embodiment, there are five primary temperature heat channels, which serve a dual function as the oven support.

Figure 3C:
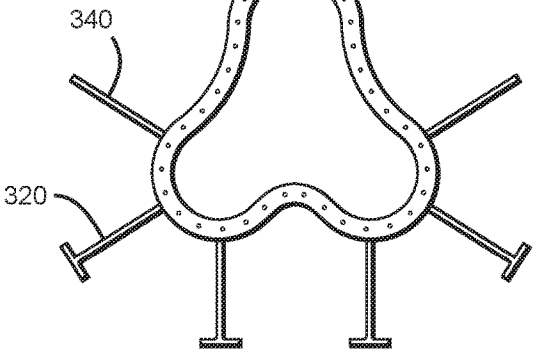
Figure 3B:
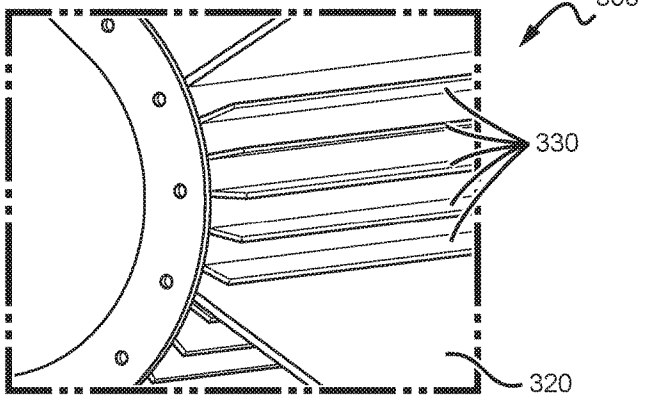

FIG. 3*b* is a close up of heating chamber 300 showing lower support blade 320 and heat sinks 330. In some embodiments, each heating channel is further divided by heat sinks 330. Heat sinks 330 create multiple secondary heat channels/channels that are smaller and extend the length of the oven. Each heating channel can be controlled to optimize the heat input into the system to eliminate over-heating areas and under-heating other areas.

FIG. 3*c* shows an alternate view of heating chamber 300, showing upper support blades 340 and lower support blades 320. The support blades (or walls) are designed to support the weight of the oven without restricting the heat to be used for multiple passes between the converter oven and the insulated outer shell casing.

The multiple heating channels are not only designed for better heat transfer in the oven, but also has incorporated an innovative and functional use as support for the oven within the specially designed insulated shell. These support the weight and allow expansion of the metal to be stable without restriction. Unlike other support options this is placed two-thirds of the length of the oven and therefore, these supports walls also act as the primary heating/temperature control channels where the material requires the most heat for the distillation/decomposition process. Additional smaller secondary walls are spaced within these channels or channels creating multiple channels along the outer oven surface to further concentrate the heat. The walls are made of high temperature stainless steel or other high temperature material that may perform the same function. The secondary channels traverse the length of the oven, however, the primary channel walls that are integrated as part of the novel support system traverse approximately two-thirds of the length of the oven. The support of the oven is required for the first two-thirds of the oven to support the weight, and the end section of the oven is supported by the base plates and attached to the outer shell casing. The supports do not traverse the length of the oven because it would restrict the airflow of the multi-pass design. The supports were designed to allow for expansion and growth of the alloy oven as it is heated. The inventive subject matter also includes a rotary dryer (when required based on moisture content of the waste) that is configured to re-circulate waste heat or utilize process steam from system for the dryer The insulated outer-shell housing is designed to have a similar shape around the oven with a space between the oven's outer wall and the insulation allowing the indirect heat to be circulated and pass around the oven. The conforming shape of the outer housing allows for a more concentrated and even distribution of heat around the oven. With interior baffles the heat is controlled for a directed multi-pass where the waste heat is vented through ducting attached to the front upper quadrant of the outer shell casing of the thermal converter.

It is contemplated that this configuration better distributes the indirect heat to areas of the oven that require more heat to maintain a stable heat transfer one the overall oven. The lower half of the oven and more specifically the bottom is the area that the waste or feedstock is processed, requiring more heat to maintain the temperature of the oven and ensuring even heat transfer. The multiple heat channels/channels are controlled to optimize the use of the heat and allow for better efficiencies.

Another contemplated benefit of the inventive subject matter is that it more control over the use of external fuel to heat the oven, which allowing it to be concentrated for better heat transfer, and reduces and stabilizes the use of external fuels that are required to generate the indirect heat when combined with the multi-pass and recirculation of flue gas. Additionally, the proposed design allows for multi-pass heating of the radiant and convective areas of the oven.

The oven design allows for repairs which will allow for longer life-cycle and reduce costs associated with a new oven.

The converter oven is made of high temperature alloy and is very large and the weight of the oven can be significant, therefore, there needs to be adequate support for the chamber that allows for the growth and expansion of the oven as it is heated. In addition the six oven supports are designed to be utilized as part of the five (5) major temperature heat channels/channels. The walls of the channels or channels extend to outer housing and each have a base that braces the wall against the outer housing.

The supports run approximately two-thirds of the length of the oven which is innovative and will allow for the entire oven to be stabilized preventing any sagging or stress on the oven associated with it exposure to high temperatures and the weight and size of the oven suspended inside the thermally-lined outer housing, but still allows for unrestricted airflows for the multi-pass design.

This is specially designed in-feed for liquids. This will allow liquid waste stream to be introduced into oven directly. This liquid feed will atomize the liquid into the oven. It can be controlled and regulated to allow for even disbursement into the upper section of the system.

The pump system can be attached to a stationary tank or attached to portable drums that are integrated into a fixed liquid feed system that atomizes the liquid inject directly in the upper half of the Pyrolytic chamber allowing for more surface area for faster decomposition or distillation.

Due to the varying degrees of viscosity of different liquids that may be processed, the system will be designed to inject low temperature steam to push the fluid into the system when required.

This multi-layer novel design has a better efficiency and less heat loss. The use of various forms of insulation coupled with an innovative application of a Water Wall tube design will optimize the retention of heat between the outer housing and the outer wall of the converter oven.

The In-feed and inlet system can be controlled to deliver waste if there is a malfunction on one of the systems. This allows for the operation of the pyrolytic converter to continue operation during troubleshooting.

The in-feed is automated and designed to determine the weight of the waste or material that is delivered into the system. The dual Air Lock system allows for redundancy if there should be a maintenance or operational malfunction on one of the sub-systems.

Figure 4:
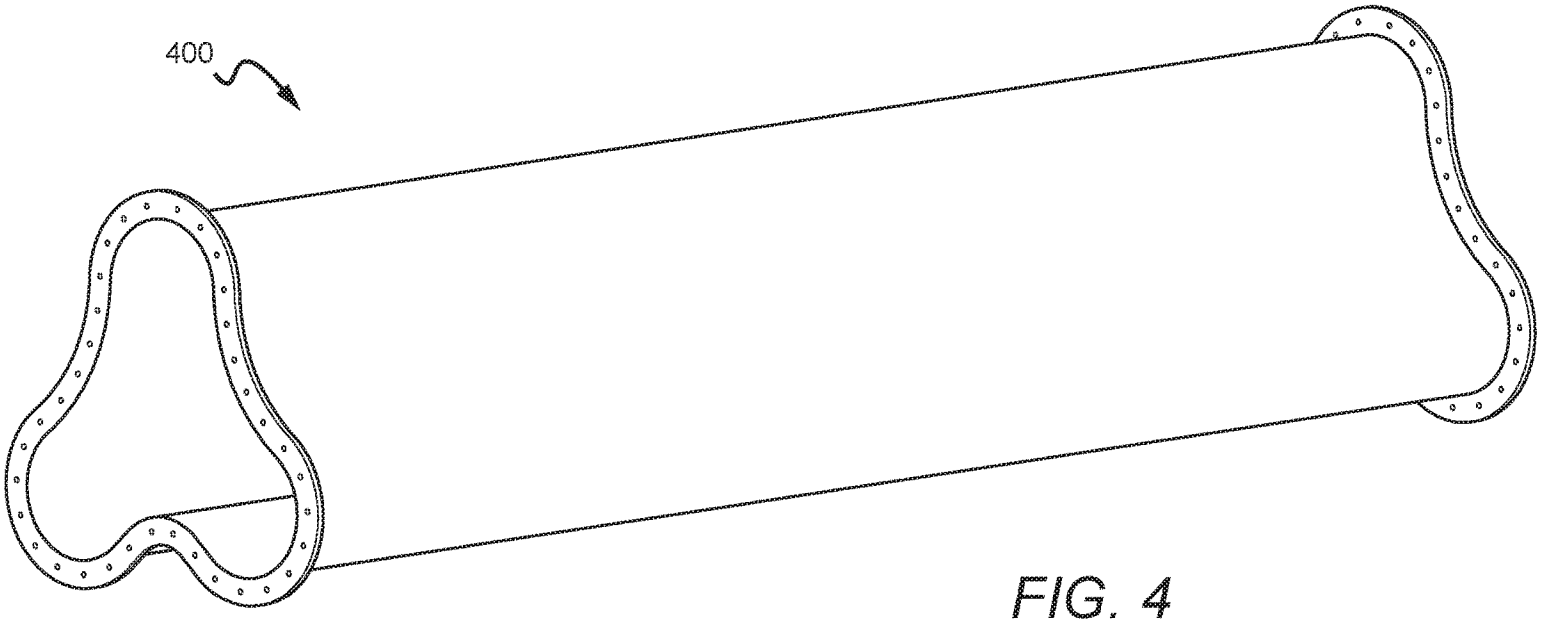
FIG. 4 illustrates a heating chamber of a pyrolytic oven.

FIG. 4 illustrates an inner heating chamber 400 of a pyrolytic oven. Heating chamber 400 has a general heart shape to accommodate for dual augers.

The oven has a radiant and convective area of the oven for the thermal heating of the system. Multi-pass provides the capability of the oven to perform more efficiently and require less external energy to maintain the thermal conversion of the system.

The overall oven design allows for it to be fabricated with high temperature alloy to minimize corrosion.

The external heat that is applied to the oven is generated by the five (5) burners located in the front lower quadrant of the thermal converter. The fuel is combusted and the heat is drawn through the thermal converter under pressure from Induced Draft Fan. The interior is designed to allow for a multi-pass of the heat before it exits the converter in the upper front quadrant to be used for other sub-systems, to include, but not limited to applications for drying and power generation options.

The design of the oven supports allows for the flow of the heat multiple pass of the heat to increase the energy efficiency of the process. This is the reason that the primary support walls to not extend the length of the oven. The last section needs to be free of any walls that would restrict the airflow.

What is claimed is:

1. A method of heating a pyrolytic converter having an elongated oven disposed within an outer shell, and at least first and second longitudinally oriented heating channels extending radially outward from an outer surface of the oven and disposed between the oven and outer shell, the method comprising:

differentially supplying first and second flows of heated gas to front portions of the first and second heating channels;

allowing the first and second flows of the heated gas to combine along an outer surface of a rear portion of the oven; and recirculating a portion of the combined flows of the heated gas between the oven and the outer shell.

2. The method of claim 1, wherein the portion of the oven in which the first and second flows combine comprises about a third of a length of the oven.

3. The method of claim 1, wherein the first and second heating channels are defined by support blades extending rearwardly from a front portion of the oven, and the step of allowing the first and second flows of the heated gas to combine along an outer surface of the rear portion of the oven comprises disposing the support blades so that they do not extend into the rear portion of the oven.

4. The method of claim 1, wherein the first heating channel is defined by support blades extending rearwardly from a front portion of the oven, and further comprising using longitudinally oriented heat sinks, disposed between the support blades, to assist in directing the first flow of the heated gas rearwardly towards the rear portion of the oven.

5. A pyrolytic converter for treating waste materials, comprising:

an elongated oven disposed within an outer shell;

wherein the elongated oven has an outer surface comprising a plurality of support blades extending radially outward and disposed between the oven and the outer shell;

the plurality of support blades oriented along a length of the oven, but having respective lengths less than the length of the oven, thereby defining at least first and second longitudinally oriented heating channels shorter than the length of the oven;

a plurality of heat sinks disposed between first and second ones of the plurality of support blades, and longitudinally oriented along the outer surface of the oven; and a heating source configured to supply heat to a first portion of the waste materials located within the first channel at a first temperature and to supply heat to a second portion of the waste materials located within the second channel at a different, second temperature.

6. The pyrolytic converter of claim 1, wherein at least one of the support blades comprises an elongated foot, configured to support a portion of the weight of the oven.

7. The pyrolytic converter of claim 5, wherein the heating source comprises a first burner for supplying heat at the first temperature for the first channel, and a separately controllable a second burner for supplying heat at the second temperature for the second channel.

8. The pyrolytic converter of claim 5, wherein the plurality of heat sinks extends beyond the first and second blades, towards a rear of the oven.

9. The pyrolytic converter of claim 5, wherein the lengths of the plurality of support blades is about two-thirds of the length of the oven.

10. The pyrolytic converter of claim 5, wherein the oven has a tri-lobed shape.

11. The pyrolytic converter of claim 5, wherein the shell has a conforming shape about the oven.

* * * * *